United States Patent [19]

Lounsberry et al.

[11] Patent Number: 4,943,989

[45] Date of Patent: Jul. 24, 1990

[54] X-RAY TUBE WITH LIQUID COOLED HEAT RECEPTOR

[75] Inventors: Brian D. Lounsberry, Brookfield; Krystyna Truszkowska, Shorewood, both of Wis.

[73] Assignee: General Electric Company, Milwaukee, Wis.

[21] Appl. No.: 227,280

[22] Filed: Aug. 2, 1988

[51] Int. Cl.[5] ..... H01J 35/10

[52] U.S. Cl. ..... 378/130; 378/127; 378/141; 378/142

[58] Field of Search ..... 378/141-144, 378/129, 130

[56] References Cited

U.S. PATENT DOCUMENTS

| | | | |
|---|---|---|---|
| H312 | 7/1987 | Parker | 378/141 |
| Re. 31,560 | 4/1984 | Devine, Jr. | 378/125 |
| 3,763,387 | 10/1973 | Silbermann | 378/144 |
| 4,132,916 | 1/1979 | Hueschen et al. | 313/330 |
| 4,165,472 | 8/1979 | Wittry | 313/35 |
| 4,187,442 | 2/1980 | Hueschen et al. | 313/60 |
| 4,189,658 | 2/1980 | Schleinkofer | 313/330 |
| 4,276,493 | 6/1981 | Srinivasa et al. | 313/330 |
| 4,298,816 | 11/1981 | Hirsch et al. | 313/330 |
| 4,320,323 | 3/1982 | Magendans et al. | 313/330 |
| 4,335,327 | 6/1982 | Wangh et al. | 378/129 |
| 4,369,517 | 1/1983 | Ozawa | 378/130 |
| 4,393,511 | 7/1983 | Jens | 378/128 |
| 4,481,655 | 11/1984 | Annis et al. | 378/125 |
| 4,573,185 | 2/1986 | Lounsberry et al. | 378/125 |
| 4,574,388 | 3/1986 | Port et al. | 378/144 |
| 4,597,095 | 6/1986 | Akpan | 378/144 |
| 4,600,659 | 7/1986 | Hong et al. | 428/471 |
| 4,607,380 | 8/1986 | Oliver | 378/138 |
| 4,622,687 | 11/1986 | Whitaker et al. | 378/141 |
| 4,625,324 | 11/1986 | Blaskis et al. | 378/141 |
| 4,631,742 | 12/1986 | Oliver | 378/113 |
| 4,645,121 | 2/1987 | Devine, Jr. | 228/194 |
| 4,688,239 | 8/1987 | Schaffner et al. | 378/141 |
| 4,715,055 | 12/1987 | Devine, Jr. | 378/144 |

FOREIGN PATENT DOCUMENTS

| | | | |
|---|---|---|---|
| 0003843 | 1/1985 | Japan | 378/141 |

*Primary Examiner*—Craig E. Church
*Assistant Examiner*—John C. Freeman
*Attorney, Agent, or Firm*—Quarles & Brady

[57] ABSTRACT

An x-ray tube includes a cathode which supplies electrons that bombard a target material to produce x-rays. The target is supported on a rotating anode that includes fins covered with a high emissivity material. An envelope surrounds these elements and provides a vacuum chamber in which they operate. A receptor is mounted to the envelope and includes fins which mate with the anode fins to enhance the radiation of heat from the rotating anode. A cooling liquid is pumped through the receptor.

1 Claim, 2 Drawing Sheets

X-RAY TUBE WITH LIQUID COOLED HEAT RECEPTOR

BACKGROUND OF THE INVENTION

The field of the invention is high power x-ray tubes used in computer aided tomography, angiography, and cineradiography, and more specifically, the cooling of the target structure in such tubes.

An x-ray tube includes a glass or metal envelope which encloses in a near vacuum a cathode electrode and a target structure which forms an anode electrode. The cathode is heated to produce electrons and a high voltage is applied across the electrodes to propel the electrons at the target material. When the electrons strike the target, x-rays and heat are produced. The x-rays are directed through a window in the envelope to perform their useful function, while the heat is dissipated through the walls of the envelope.

As the power of the x-ray tube increases, the measures required to effectively dissipate the heat become more demanding. The target is constructed of a material, such as tungsten, which can be operated at high temperatures and its mounting structure is typically coated with a high emissivity material which radiates heat to the surrounding envelope. In some industrial application where metal envelopes are used, the interior surface of the envelope may also be coated with a high emissivity material which absorbs the radiated heat from the target. Heat radiating fins or a manifold for conveying a cooling liquid may be formed on the outer surface of the envelope to remove the heat.

While such radiant and convective heat transfer strategies cool the target structure, they do not keep the temperature of the target material directly in the path of the electron beam sufficiently cool when high powered x-ray pulses are required. As described in U.S. Pat. Nos. 3,869,634; 4,187,442; 4,272,696; 4,393,511; and 4,569,070, the recognized solution to this problem is to form the target on a disc, and to rotate the disc such that the target material which is subjected to the electron bombardment is continuously changed. For example, the tungsten target material may be deposited as a band, or focal track, around the periphery of the disc, and the disc is rotated at a speed of from 3,000 to 10,000 revolutions per minute. Although such rotation reduces localized heating of the target material, it complicates the cooling of the target structure since the target structure now includes a rapidly rotating disc driven by a motor. In addition, a vastly increased amount of heat is produced because of the increased power levels which can be achieved.

SUMMARY OF THE INVENTION

The present invention relates to the cooling of a rotary x-ray target, and in particular, to the removal of heat from the rotating target. More specifically, the invention includes an envelope containing a cathode, and a rotating anode which forms a target for electrons emitted from the cathode to produce x-rays, a high emissivity surface formed on the rotating anode, a receptor mounted to the envelope and having a high emissivity surface which is oriented in close proximity to the high emissivity surface on the rotating anode, and the receptor includes a liquid manifold for receiving cooling fluid which flows therethrough to remove heat conducted from its high emissivity surface.

A general object of the invention is to cool a rotating x-ray target. The target forms only a small part of the rotating anode surface. The remaining portions of the anode surface may be covered with a high emissivity surface to enhance the radiation of energy. The amount of energy radiated from such surface is increased further by cooling the high emissivity surface formed on the stationary receptor which is located in close proximity to the rotating anode.

Another object of the invention is to increase the power of the x-ray tube. By increasing the rate at which heat is removed from the rotating anode, the rate at which x-rays and associated heat are produced can be increased. Maximum power is achieved by forming annular fins on the rotating anode to increase the area of its heat radiating surface, and by forming mating fins on the stationary receptor to increase the high emissivity cooling surface which is in close proximity to the anode.

Yet another object of the invention is to provide a cooling system for a rotating x-ray anode which is reliable and which can be economically manufactured. The x-ray target is formed on the front surface of the disc-shaped anode and the annular fins are formed on its back surface, around the stem which supports and rotates the anode. The receptor is positioned around the stem and its fins extend forward to interdigitate with the anode fins. Cooling fluid is pumped through the stationary receptor to remove heat.

Yet a more specific object of the present invention is to cool the rotating anode more effectively without requiring complex and uncertain changes in the design and manufacture of the anode disc. The manufacture of rotating x-ray tube anodes is very complex and difficult due to the high speed at which they are rotated and the high temperature at which they are operated. The present invention does not require any changes to this technology.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE INVENTION

Figure 1:
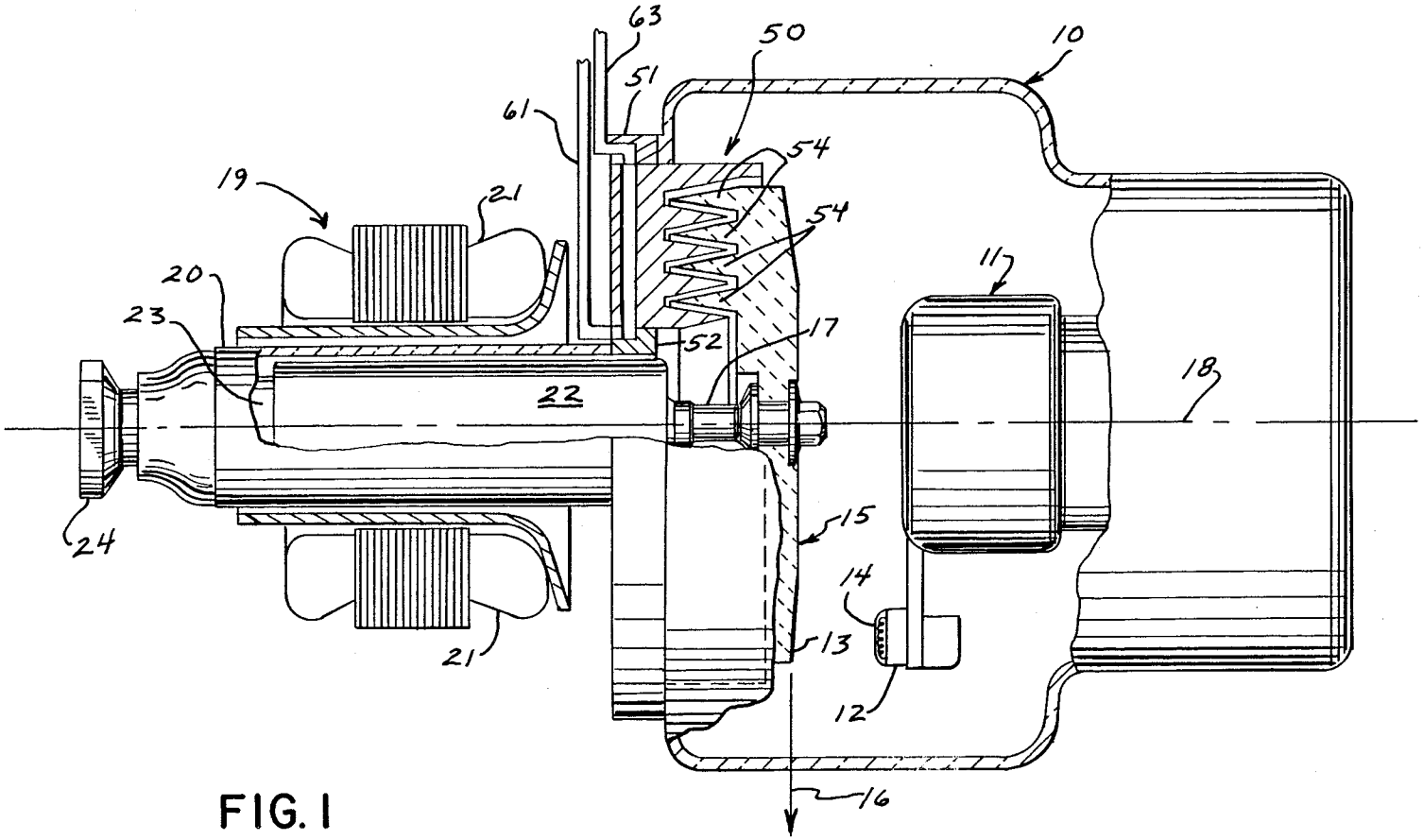
FIG. 1 is a side elevational view with parts cut away of an x-ray tube which incorporates the present invention.

The rotating anode x-ray tube in FIG. 1 has several conventional features which will be described first. The tube includes an envelope 10 made of borosilicate glass. A cathode structure 11 is sealed into the right end of the tube and electrical conductors leading to the cathode structure 11 (not shown) extend through the glass envelope 10 to connect with a high voltage source and a source of cathode heating current. The cathode structure has a focusing cup 12 in which there is an electron emissive filament 14 which serves to provide an electron beam that is attracted to an x-ray target 13. The x-ray target 13 is formed as a layer of a high atomic number material such as tungsten or molybdenum in a track on the front surface of a disc-shaped anode 15. The anode disc 15 is formed of a refractory material such as tungsten, molybdenum or graphite, although molybdenum is preferred because it conducts heat better than graphite and is lighter in weight than tungsten. The anode 15 is connected to a high voltage source (not shown) and the electrons emitted by the filament 14 are attracted to the anode 15 where they impinge on the x-ray target 3. As a result, x-rays are produced in a beam indicated by arrow 16 that extends downward through the glass envelope 10.

In addition to producing x-rays, the impinging electrons produce large amounts of heat. For this reason, the anode disc is mounted on a stem 17 which is rotated about central axis by an induction motor indicated generally at 19. The target material 13 is formed as a track around the periphery of the anode disc 15 as described in U.S. Pat. No. 4,573,185, and by rotating the anode 15 at speeds as high as 10,000 rpm, the target material 13 subjected to the electron bombardment is continuously rotated out of the electron beam where it can cool before completing one revolution and re-entering the beam. As a result, the temperature of each segment of the target material focal track 13 cycles between a high temperature of 2000° C. to 3000° C. as it leaves the electron beam and a low temperature of 1200° C. to 1400° C. which is the bulk temperature of the anode disc 15.

A variety of construction techniques have been proposed for rotating x-ray anodes. Many of these techniques, such as those disclosed in U.S. Pat. Nos. 4,052,640; 4,109,058; 4,119,879; 4,132,916; 4,195,247; 4,298,816; RE 31,560; 4,574,388; 4,597,095; 4,641,334; 4,645,121; 4,689,810; and 4,715,055, concern the attachment of the target material to the anode substrate such that it will withstand the high rotational speeds, high temperatures and the resulting stresses. Other construction techniques, such as those disclosed in U.S. Pat. Nos. 4,276,493 and 4,481,655, concern the attachment of the anode disc 15 to the stem 17 such that the heat which is conveyed through the stem 17 to the induction motor bearings is kept to a minimum. Regardless of the technique employed, the anode disc 15 typically has a diameter of 3 to 5 inches and a weight of 2 to 5 pounds and its entire surface becomes an energy radiator. It is an important advantage of the present invention that the anode disc 15 can be constructed using well known and established technology.

As indicated above, the x-ray tube narrows at its left end to form a neck 20 which contains the rotor of induction motor 19. The stator windings 21 of this motor 19 are wound around the neck 20 and its rotor 22 is contained within the neck 20. As described in U.S. Pat. No. 4,147,442, the stem 17 is fastened to the right end of the rotor 22, and the rotor is, in turn, supported within the neck 20 by a stationary shaft 23 which extends from its left end. The shaft 23 mounts to the end of the neck 20 and it extends into the rotor 22 where it is rotatably fastened thereto by two sets of ball bearings (not shown). The materials used for the stem 17 and the components of the rotor 22 are selected to inhibit the flow of heat from the anode 15 to the rotor bearings, while providing good electrical conductivity. The power supply lead for the anode 15 connects to a terminal 24 which extends from the left end of the neck 20 and electrical conductivity is required through the shaft 23, rotor 22 and stem 17.

The envelope 10 that defines the main cavity which houses the cathode 11 and anode 15 is made of glass. Similarly, the neck 20 of the envelope is constructed of an electrically insulating glass. These two glass segments 10 and 20 are joined by a receptor 50 which is disposed immediately behind the rotating anode 15 and around the forward end of the neck 20. The receptor 50 is constructed of copper and it is attached to the glass envelope 10 through a suitable sealing metal and by a stainless steel outer annular ring 51 that is brazed to the receptor's circular outer surface. Similarly, a stainless steel inner annular ring 52 is brazed to the inner circular surface of the receptor 50 and it is attached to the glass neck 20 through a suitable sealing metal. The receptor 50, the glass neck 20, and the glass envelope segment 10 form a complete envelope which enables a near vacuum to be maintained within the x-ray tube. As will now be described in further detail, the receptor 50 also serves to remove most of the heat produced at the anode while the x-ray tube is in use.

Figure 2:
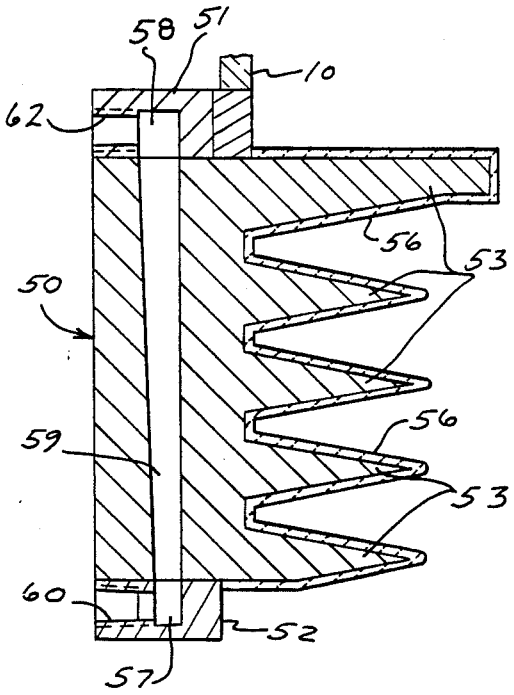
FIG. 2 is a partial view in cross-section taken through the receptor which forms part of the x-ray tube of FIG. 1.
Figure 3:
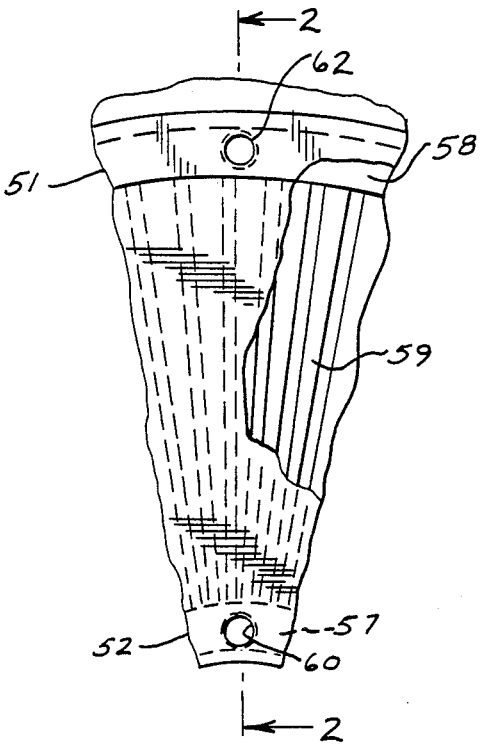
FIG. 3 is a partial view of the receptor which forms part of the x-ray tube of FIG. 1.

Referring particularly to FIGS. 1–3, the copper receptor 50 is shaped on its front surface to provide a set of concentric fins 53 that interdigitate with a corresponding set of concentric fins 54 that are formed on the back surface of the anode disc 15. As a result, considerable surface area is formed on the back of the anode disc 15 and this surface area is disposed in close proximity to the considerable forward surface of the receptor 50. The gap between the anode fins 54 and the receptor fins 53 is sufficient to insure that no contact occurs between them and that thermal expansion can be accommodated as well as reasonable manufacturing tolerances. However, this gap is kept to a minimum so that radiant heat transfer from the hot, rotating anode disc 15 to the cool, stationary receptor 50 is maximized.

To further enhance the transfer of radiant energy between the anode 15 and the receptor 50, the surfaces of the interdigitating fins 53 and 54 are coated with a high emissivity material. This layer is shown in FIG. 2 at 56. The high emissivity layer 56 on the receptor fins 53 is composed of titanium dioxide ($TiO_2$), while the preferred formulation and the method of manufacture of the coating on the anode fins 54 is described in U.S. Pat. Nos. 4,132,916 and 4,600,659, which are incorporated herein by reference. These coatings withstand the high temperatures which are produced at the anode disc 15 and they provide a high thermal emittance in the range of 0.80 to 0.94.

To further enhance the transfer of heat from the rotating anode disc 15 to the receptor 50, the receptor 50 is cooled to a relatively low temperature by a liquid coolant Referring still to FIGS. 1–3, an input manifold 57 is formed within the inner annular ring 52 and an output manifold 58 is formed within the outer annular ring 51. The manifolds 57 and 58 are fluid cavities which extend around the entire inner and outer circumference of the receptor 50 and which communicate with numerous radially directed channels 59. The input manifold connects to a source of cooling fluid through two to four equally spaced input ports 60 that attach to a tube 61. Similarly, the output manifold 58 has two to four equally spaced exhaust ports 62 which return the cooling fluid to its source through tubing 63. The cooling fluid enters the input manifold at a pressure of approximately 80 psi, from which it flows into the many channels 59 and flows radially outward to the output manifold 58. In flowing through the channels 59, the temperature of the cooling fluid is raised as it absorbs heat from the receptor 50 by forced convection. In the preferred embodiment shown, the receptor temperature is maintained below 300° C. while the bulk temperature of the anode 15 rises to 1200° C. to 1400° C.

Figure 4:
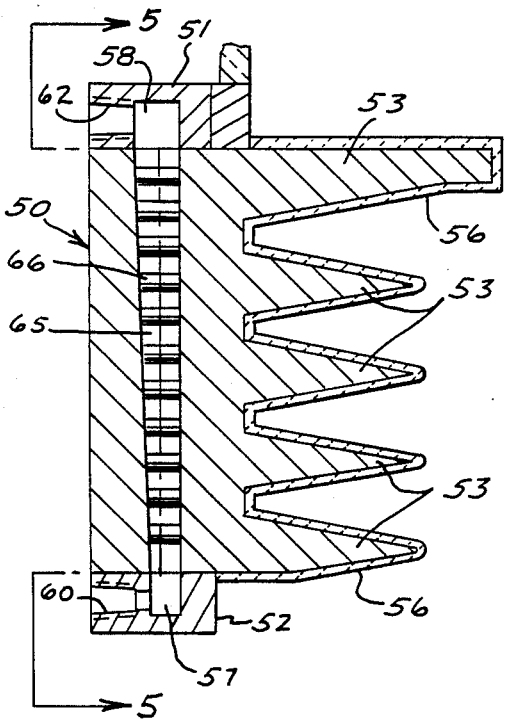
FIG. 4 is a partial view in cross-section as in FIG. 2 of an alternative embodiment of the receptor.
Figure 5:
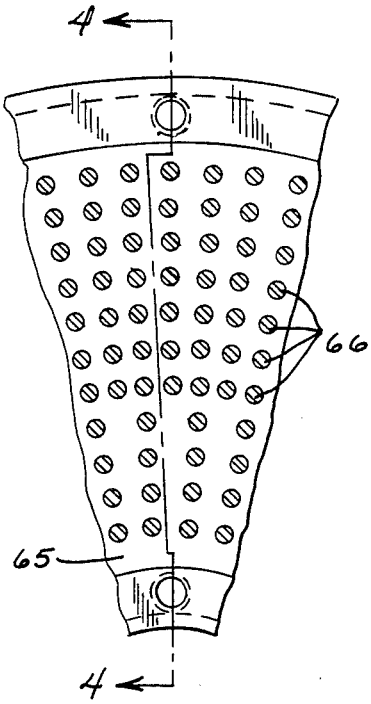
FIG. 5 is a partial view of the alternative embodiment of the receptor of FIG. 4.

Many variations are possible from the preferred embodiment of the invention shown in FIGS. 1–3. One of these is shown in FIGS. 4 and 5 where the fluid channels formed in the receptor 50 have been changed. More specifically, instead of a large number of separate, radially directed channels 59, the alternative receptor 50 has a single chamber 65 which connects the two manifolds 57 and 58 throughout the entire circumference of the receptor 50. Numerous copper pins 66 extend across the chamber 65 to intercept the radially moving cooling fluid and efficiently convey heat from the receptor 50. The number and position of the pins can be adjusted to provide both even and efficient cooling.

Many other variations are possible without departing from the spirit of the present invention. For example, the fins 53 and 54 are tapered to enable their easy manufacture, however, they may have other shapes. The important considerations are that the fins provide an extensive surface area over which heat can be radiated from the anode disc 15 to the receptor 50 and that their surfaces be in close proximity to insure that hot surfaces of the anode fins 54 radiate only to the cooler surfaces of the receptor fins 53. Also, while the cooling fluid in the preferred embodiments remains a liquid during its passage through the receptor 50, it is possible to allow the fluid to undergo nucleate boiling during its passage through the receptor 50.

In the preferred embodiment the receptor 50 is operated at the high voltage of the anode 15 and it is electrically insulated from its surroundings. This requires that a cooling fluid having a high dielectric strength be employed for electrical insulation purposes. The coolant should also have good convective heat transfer properties for efficient cooling. An electronic coolant such as the liquid sold by Minnesota Mining and Manufacturing, Inc. under the trade name "Flourinert" is used for this purpose, since it offers these properties and is relatively inert.

In the alternative, it is also possible to operate the anode disc 15 and the receptor 50 at ground potential. In such case, no electrical isolation is required and the preferred coolant is water.

We claim:

1. In an x-ray tube having an envelope which contains a cathode that emits electrons, and a rotating anode which includes a target surface against which the electrons impinge to produce x-rays, the improvement therein comprising:

an emissive anode surface formed on the exterior of the rotating anode to enhance the radiation of thermal energy therefrom;

a stationary receptor mounted to the envelope and having an emission receptor surface which is positioned in facing relation and in close proximity to the emissive anode surface on the exterior of the rotating anode; and a fluid chamber formed in the stationary receptor for receiving a cooling fluid that removes heat from the stationary receptor;

the stationary receptor including a plurality of pins which are formed of a heat conductive material and which extend across the fluid chamber and in the path of the cooling fluid.

* * * * *